United States Patent [19]

Ernst

[11] Patent Number: 4,840,294

[45] Date of Patent: Jun. 20, 1989

[54] ADJUSTABLE DISPENSING TOOL

[75] Inventor: Richard J. Ernst, Palatine, Ill.

[73] Assignee: Illinois Tool Works Inc., Chicago, Ill.

[21] Appl. No.: 155,447

[22] Filed: Feb. 12, 1988

[51] Int. Cl.[4] ..... B65D 5/08

[52] U.S. Cl. ..... 222/287; 222/391

[58] Field of Search ..... 222/326–327, 222/287, 391; 74/833, 522, 141.5

[56] References Cited

U.S. PATENT DOCUMENTS

| | | | |
|---|---|---|---|
| 2,092,738 | 9/1937 | Rodgers | 74/522 X |
| 2,282,148 | 5/1942 | Mandl . | |
| 2,520,652 | 8/1950 | Pfauser . | |
| 2,634,692 | 4/1953 | Sherbondy | 222/391 X |
| 3,235,296 | 2/1966 | Day . | |
| 3,657,944 | 4/1972 | Able | 74/544 |
| 3,894,663 | 7/1975 | Carhart et al. | 222/391 X |
| 4,204,616 | 5/1980 | Chang | 222/391 |
| 4,330,070 | 5/1982 | Doubleday | 222/43 |
| 4,664,298 | 5/1987 | Shen | 74/522 X |
| 4,681,524 | 7/1987 | Ikeda et al. | 222/326 X |

FOREIGN PATENT DOCUMENTS

| | | | |
|---|---|---|---|
| 1011470 | 12/1965 | United Kingdom | 222/391 |

*Primary Examiner*—Joseph J. Rolla
*Assistant Examiner*—Mona C. Beegle
*Attorney, Agent, or Firm*—Thomas W. Buckman; Neal C. Johnson

[57] ABSTRACT

A tool for use in dispensing fluids, such a liquid two-part epoxies. The tool has an actuating mechanism which includes a lever which is adjustable to accommodate materials of varying viscosities. Adjustment is achieved by axially moving a bolt within the trigger of the tool, which results in a change in the mechanical advantage thereof.

7 Claims, 2 Drawing Sheets

ADJUSTABLE DISPENSING TOOL

BACKGROUND AND SUMMARY OF THE INVENTION

The present invention relates to a tool for dispensing fluids such as two-part epoxy components. The tool employs a lever mechanism, the mechanical advantage of which can be adjusted to accommodate fluids having different viscosities.

The need for the ability to dispense materials of different viscosities arises in at least two situations. First, the same material may change viscosity significantly as a result of changes in temperature. Secondly, a user may want to use a single tool to dispense different materials having significantly different formulations, and therefore, viscosities, because application may require that such formulations be used.

The tool of the present invention includes a frame which is preferably able to hold a cartridge having two separate chambers. A pair of pistons and corresponding parallel piston rods are carried by the frame. A third pushing rod, parallel to the piston rods, is attached to the piston rods at one end. Axial forces applied to the pushing rod are transferred to the piston rods through a connecting plate. A canted nut has an aperture through which the pushing rod extends. A lever actuates the canted nut causing axial movement of the rods.

The lever of the tool is comprised of an externally threaded bolt or trigger, which threads into an internally threaded fulcrum adjacent to the canted nut. One end of the bolt contacts the canted nut as the bolt moves in a pivoting motion about the pivot axis of the fulcrum. Rotation of the bolt varies the distance between the pivot axis and the point of contact between the bolt and the canted nut.

DESCRIPTION OF THE PREFERRED EMBODIMENT OF THE INVENTION

Figure 1:
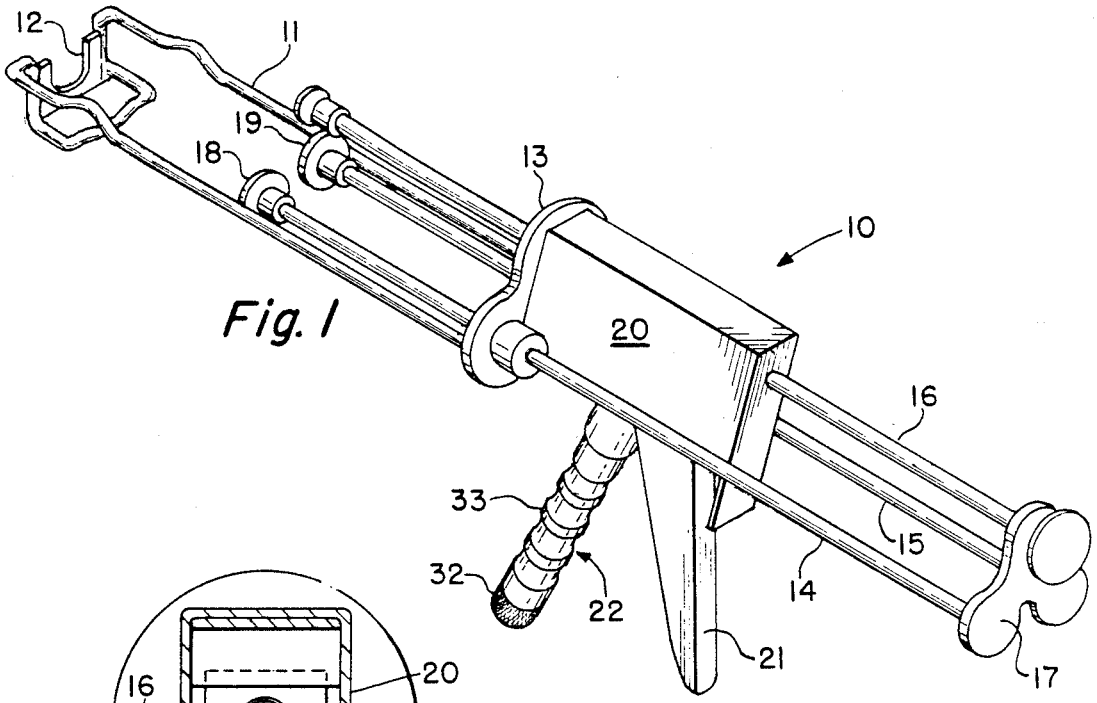
FIG. 1 is a perspective view of a tool embodying the present invention.

In FIG. 1, an overall view of the tool 10, shows a cartridge carrying frame 11 having a yoke 12 at one end and base plate 13 at the other. Projecting through the base plate 13 are three rods, two piston rods 14 and 15, and a pushing rod 16. The three rods are joined at one end by a connecting plate 17. Pistons 18 and 19 are fixed to the ends of the piston rods 14 and 15, respectively.

A rod actuating housing 20 is mounted to the base plate 13. A rear handle 21 and trigger 22 depends from one side of the housing 20.

Figure 2:
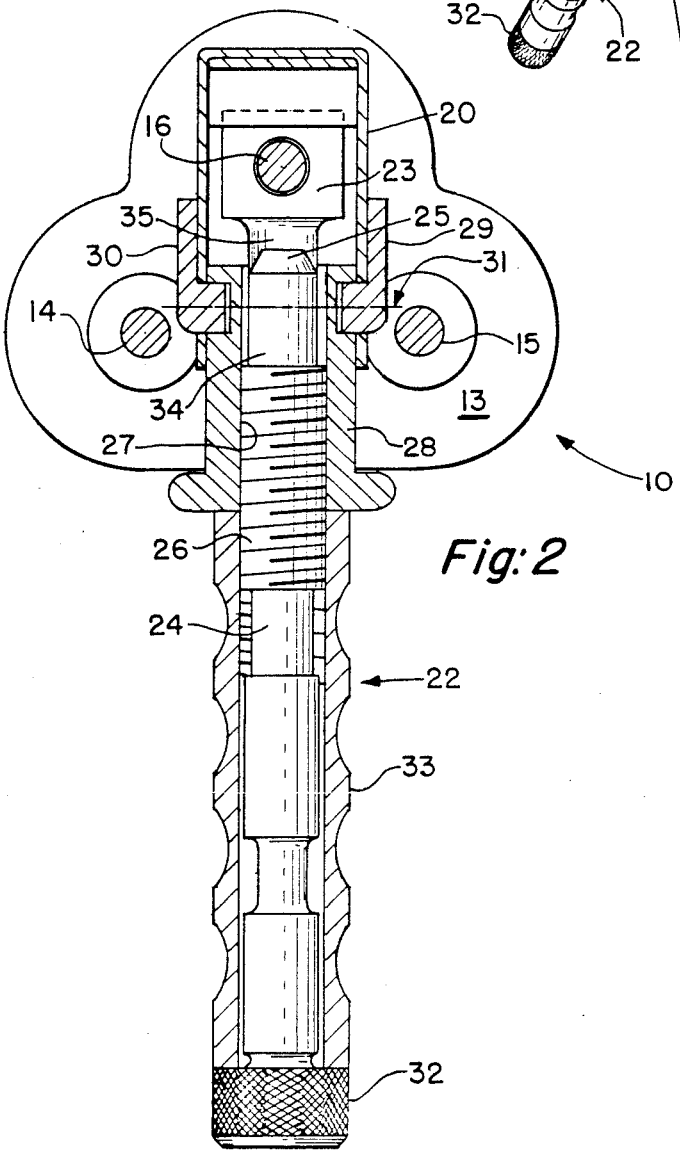
FIG. 2 is a sectional view taken along line 2—2 of FIG. 3.
Figure 3:
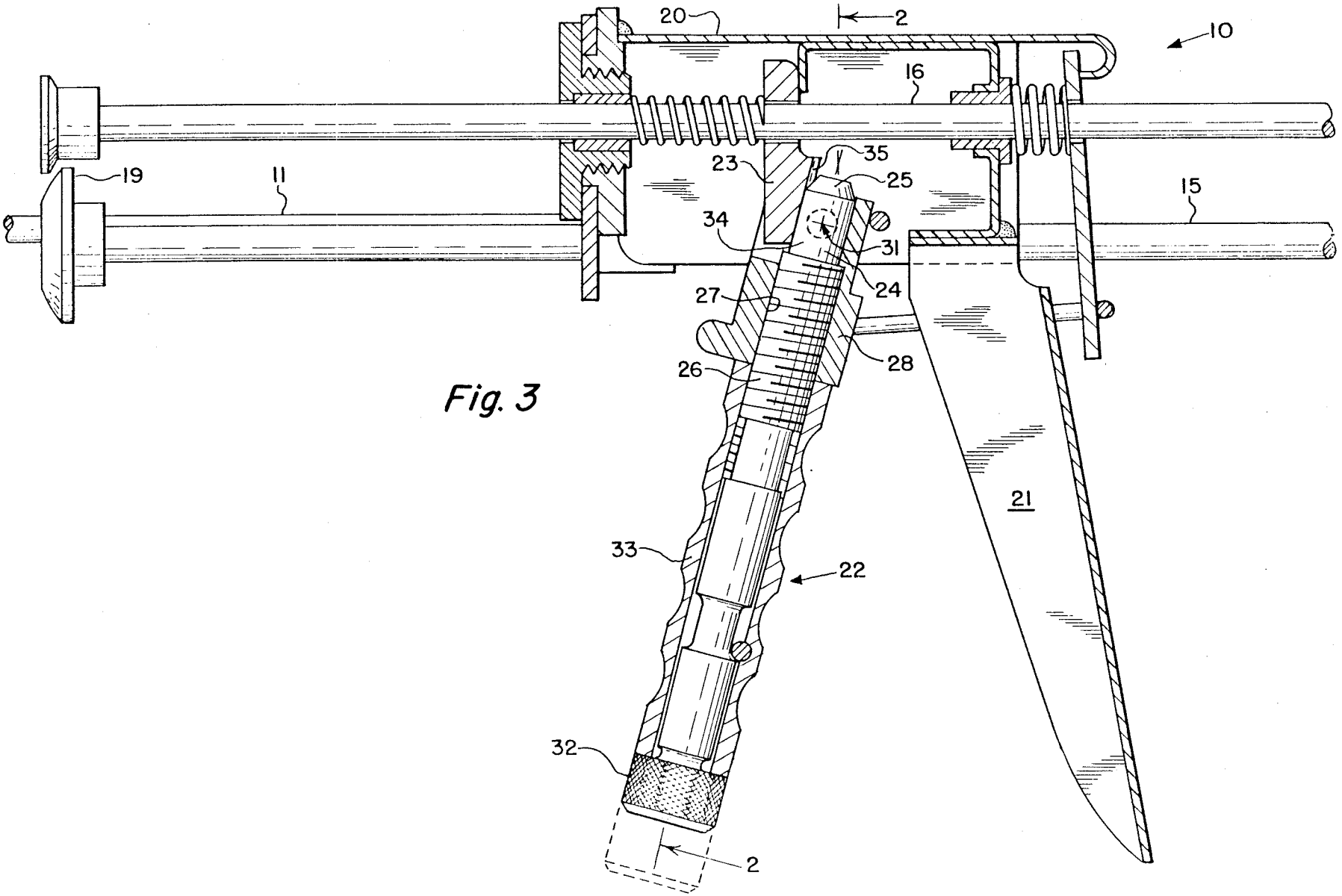
FIG. 3 is a longitudinal view in partial section of the tool shown in FIGS. 1 and 2.

FIGS. 2 and 3 shown the internal components of the housing 20 and the trigger 22. A canted nut or feed plate 23 surrounds the pushing rod 16. Eccentric forces are applied to the feed plate 23 by a lever bolt 24 having a rounded end 25. The bolt 24 has threads 26 over a portion of its length. The threads 26 of the bolt 24 mate with the threads 27 of a nut which acts as a fulcrum 28. The fulcrum 28 is supported by pins 29 and 30 attached to the housing 20. The pins 29 and 30 define a pivot axis 31, perpendicular to the bolt 24, about which the bolt 24 and fulcrum 28 pivot.

The bolt 24 has an enlarged knurled end 32 to facilitate rotation of the bolt 24 within the fulcrum 28. Such rotation causes axial movement of the bolt 24, resulting in a change in the distance between the point at which the rounded end 25 contacts the feed plate 23 and the pivot axis 31. The axial position of the bolt 24 can be fixed by use of the locking sleeve 33. The sleeve 33 is threaded on to the bolt 24 and can be tightened against the fulcrum, which is prevented from rotating about the bolt 24. Axial adjustment of the bolt 24 is facilitated by the presence of a curved surface 35 on the feed plate 23, which is oriented generally parallel to the trigger 22 when at rest. The bolt 24 has an unthreaded cylindrical section 34 adjacent to the rounded end 25. The curvature of the cylindical section 34, the rounded end 25, and the curved surface 35 are all generally equal.

Changing the distance between the point at which the rounded end 25 contacts the feed plate 23 and the pivot axis 31 varies the mechanical advantage of the trigger. This means that without changing the operator's hand positions on the trigger 22 or rear handle 21, materials of different viscosities can be dispensed with the same amount of squeezing force.

While the invention has been described herein with reference to a certain embodiment, it should be understood that many variations, alternatives, and modifications may be made to the descibed embodiment without departing from the spirit and scope of the appended claims.

The invention is claimed as follows:

1. A tool for dispensing fluid, comprising a frame for carrying a cartridge containing a fluid, a pushing rod for reaching into said cartridge, a canted nut surrounding said rod for gripping said rod along its length, a manually operable lever for engaging said canted nut at a given distance from said rod, said lever being adjustable along its axis to vary said given distance, said lever comprising an elongated member at least partially threaded, a rotatable fulcrum threaded to mate with a portion of said member, whereby mechanical advantage provided by said lever may be changed to accommodate fluids of different viscosities.

2. A tool in accordance with claim 1 wherein said elongated member is externally threaded, and said fulcrum is internally threaded.

3. A tool in accordance with claim 1 wherein said elongated member has a partially rounded end and an enlarged knurled end.

4. A tool in accordance with claim 3 wherein said canted nut has a surface which is partially cylindrical, said surface and said rounded end having similar curvature.

5. A tool for dispensing materials of different viscosities comprising a cartridge carrying frame, at least one axially movable pushing rod operably connected to said frame, means for exerting an axial pushing force on said rod, said means comprising rod gripping means for engaging selected portion of said rod, lever means for moving said rod and said rod gripping means, means for adjusting mechanical advantage provided by said lever means such that said advantage may be varied to accommodate said materials, said means for adjusting mechanical advantage including a threaded portion on said lever axially adjustably connected to a pivoting fulcrum, said fulcrum being pivotable about a support means connected to said frame.

6. A tool in accordance with claim 5 wherein said support means comprises a pair of pins engaging opposite sides of said fulcrum.

7. A tool for dispensing fluid, comprising a frame for carrying a cartridge containing a fluid, a pushing rod for reaching into said cartridge, a canted nut surrounding said rod for gripping said rod along its length, a manually operable lever for engaging said canted nut, said lever comprising an elongated member at least partially threaded, a rotatable fulcrum threaded to mate with a portion of said member and having a pivot axis, said lever being adjustable along its axis to vary the distance between the point of contact with said canted nut and the rotatable axis of the fulcrum, whereby mechanical advantage provided by said lever may be changed to accommodate fluids of different viscosities.

* * * * *